US011559113B2

(12) United States Patent
Ito

(10) Patent No.: US 11,559,113 B2
(45) Date of Patent: Jan. 24, 2023

(54) PLUG FOR BUCKLE, AND BUCKLE

(71) Applicant: YKK CORPORATION, Tokyo (JP)

(72) Inventor: Naoyuki Ito, Kurobe (JP)

(73) Assignee: YKK CORPORATION

( * ) Notice: Subject to any disclaimer, the term of this patent is extended or adjusted under 35 U.S.C. 154(b) by 8 days.

(21) Appl. No.: 17/311,205

(22) PCT Filed: Dec. 7, 2018

(86) PCT No.: PCT/JP2018/045088
§ 371 (c)(1),
(2) Date: Jun. 4, 2021

(87) PCT Pub. No.: WO2020/115894
PCT Pub. Date: Jun. 11, 2020

(65) Prior Publication Data

US 2022/0117362 A1 Apr. 21, 2022

(51) Int. Cl.
*A44B 11/26* (2006.01)

(52) U.S. Cl.
CPC ..... *A44B 11/266* (2013.01)

(58) Field of Classification Search
CPC ..... A44B 11/266
See application file for complete search history.

(56) References Cited

U.S. PATENT DOCUMENTS 7,111,368 B2 * 9/2006 Matoba ..... A44B 11/266 24/615
8,365,368 B2 * 2/2013 Kaneko ..... A44B 11/2592 24/615
9,113,680 B2 * 8/2015 Takazakura ..... A44B 11/266
9,585,441 B2 * 3/2017 Kaneko ..... A44B 11/266
10,820,666 B1 * 11/2020 Lin ..... A44B 11/2519
2010/0306976 A1 12/2010 Kaneko et al.
2012/0198666 A1 8/2012 Nanbu et al.
(Continued)

FOREIGN PATENT DOCUMENTS

JP 2013063149 4/2013
WO 2009093313 7/2009
(Continued)

OTHER PUBLICATIONS

Ito, Naoyuki; International Search Report and Written Opinion for PCT/JP2018/045088, filed Dec. 7, 2018, dated Feb. 5, 2019, 16 pgs.

*Primary Examiner* — Robert Sandy
(74) *Attorney, Agent, or Firm* — Taylor English Duma LLP

(57) ABSTRACT

A plug for a buckle includes an attachment portion configured to be attached to the predetermined members; a pair of leg portions protruding in the same direction away from the attachment portion; extending portions extending in a direction from tip end portions of the pair of leg portions toward base end portions of the leg portions; a coupling piece coupling the base end portions of the pair of leg portions; a first restricting portion that is located at an intermediate portion of the coupling piece and faces extending ends of the extending portions; and second restricting portions that protrude from two sides in a longitudinal direction of the coupling piece in a manner of sandwiching the first restricting portion, extend in a protruding direction of the leg portions, and face inner side surfaces of the leg portions.

20 Claims, 18 Drawing Sheets

(56) References Cited

U.S. PATENT DOCUMENTS

| | | | |
|---|---|---|---|
| 2013/0091670 | A1 | 4/2013 | Nanbu et al. |
| 2013/0117974 | A1 | 5/2013 | Kaneko et al. |
| 2013/0232743 | A1 | 9/2013 | Takazakura |
| 2015/0013121 | A1 | 1/2015 | Kaneko |
| 2015/0201714 | A1 | 7/2015 | Nanbu et al. |

FOREIGN PATENT DOCUMENTS

| | | |
|---|---|---|
| WO | 2011039857 | 4/2011 |
| WO | 2012066615 | 5/2012 |
| WO | 2013121559 | 8/2013 |

* cited by examiner

PLUG FOR BUCKLE, AND BUCKLE

TECHNICAL FIELD

The present invention relates to a plug for a buckle including a plug and a socket that are coupled to respective portions of a tape, a belt, or other members and can be separated from these portions, and relates to a buckle using the plug.

BACKGROUND ART

In the related art, for example, a buckle disclosed in Patent Literatures 1 to 4 is a buckle that detachably couples two objects to be coupled. The buckle includes a plug and a socket. The plug includes an attachment portion provided with an insertion hole through which a belt, a tape, or the like is inserted and coupled, and a pair of leg portions that are substantially parallel to each other from two end portions in a longitudinal direction of the attachment portion and protrude in a direction perpendicular to the longitudinal direction of the attachment portion. The leg portions are elastically swingable, and are provided with a pair of engagement protrusions that protrude in a front-back direction at tip end portions of the leg portions. The socket into which the plug is fitted also includes an attachment portion formed with an insertion hole for a belt, a tape, or the like, and a hollow plug fitting portion is integrally provided at one edge side of the attachment portion. The plug fitting portion includes a plug insertion port that is opened to a tip end side opposite to the attachment portion, and the plug fitting portion is formed into a flat housing including a front surface plate and a back surface plate. Operation ports for operating the leg portions of the plug are formed on two side surfaces of the front and back surface plates orthogonal to the plug insertion port. Counterpart engagement portions are formed in the vicinity of an attachment portion side of the operation ports, and the counterpart engagement portions respectively engage with the pair of engagement protrusions of the pair of leg portions of the plug that is inserted into the plug fitting portion on an inner surface of the plug fitting portion.

In particular, a plug for a buckle disclosed in Patent Literature 1 includes a movement restricting portion provided at each leg portion of the plug in a manner of protruding in a direction of facing each leg portion, and a deformation restricting portion that is separated from the movement restricting portion and restricts deformation of the leg portion due to contact with the movement restricting portion when the leg portion is deformed to a side opposite to the direction of facing the leg portion.

A buckle disclosed in Patent Literature 2 includes a coupling portion that couples a pair of leg portions and has a curved portion formed into a convex shape at a base portion side, serving as a structure for preventing damage to the leg portions. A pair of protruding portions are provided between the pair of leg portions, the protruding portions protrude from a base portion in a coupling direction with a socket that is a female member, and face each other across at least a part of the curved portion. The pair of leg portions can be elastically deformed so that tip end sides of the leg portions are expanded, and the coupling portion can be extended due to elastic deformation of the curved portion when the leg portions are expanded. Each of the pair of protruding portions engages with the curved portion when the coupling portion is extended, restricts the extension of the coupling portion, and prevents the leg portions from being damaged.

In buckles disclosed in Patent Literatures 3 and 4, leg portions are formed in a manner of linearly protruding from two sides in a width direction of a base portion toward a length direction (an insertion direction of a plug into a socket), and the leg portions include elastic piece portions that are elastically deformable in the width direction in which the elastic piece portions come close to each other or are separated from each other, and operation portions that extend from tip end portions of the elastic piece portions toward the insertion direction of the plug. Each of the operating portions has a through hole passing through the plug in a thickness direction, and towards a tip end of the operation portion, an outer side surface (a surface opposite to a surface facing the leg portions) of the operation portion is formed to be inclined to an inner side (a side facing the leg portions), that is, in a direction in which the leg portions come close to each other. In structures for preventing damage to the leg portions of the buckle disclosed in Patent Literatures 3 and 4, tip end portions of the leg portions are coupled by a coupling portion, the coupling portion is elastically deformable, and a pair of leg portions are prevented from being deformed outward beyond a predetermined extent. Accordingly, when an excessive force (force in an outward direction) is applied to the leg portions, breakage of the leg portions is prevented.

CITATION LIST

Patent Literature

Patent Literature 1: WO 2012/066615
Patent Literature 2: JP-A-2013-63149
Patent Literature 3: WO 2011/039857
Patent Literature 4: WO 2013/121559

SUMMARY OF INVENTION

Technical Problem

In the plug for a buckle disclosed in Patent Literature 1, the deformation restricting portion that restricts movements of the leg portions is formed into a member that protrudes in a columnar shape from the center of the base portion of the plug, the number of components of the plug is large, a structure of the plug is complicated, and the plug is heavy. Since the movement restricting portion and the deformation restricting portion are brought into contact with each other at one place, a sufficient restricting effect for protecting the leg portions may not be obtained. Since a guide portion that is the deformation restricting portion protrudes to a central portion of the plug, the guide portion is likely to be caught by the pair of leg portions and other members, and is likely to be damaged during use.

In the plug for a buckle disclosed in Patent Literatures 2 to 4, since the pair of leg portions are coupled to each other by a coupling body, the coupling body also needs to be deformed during elastic deformation due to an operation of the leg portions, and operability may not be good due to resistance of the deformation of the coupling body. In order to improve operability, the coupling body may have a flexible structure. However, strength is reduced and the coupling body cannot have a protection function for the leg portions. Protection for the leg portions and improvement of operability are contradictory problems. In addition, the number of components of the plug is large, a structure of the plug is complicated, and the plug is heavy.

The present invention has been made in view of the problems in the related art as described above, and an object of the present invention is to provide a plug for a buckle and a buckle using the plug that can prevent deformation or damage to leg portions of the plug due to an unnecessary force from the outside and that has good operability.

Solution to Problem

The present invention provides a plug for a buckle including a plug and a socket that are configured to be coupled to each other or uncoupled from each other and to be respectively attached to predetermined members. The plug includes an attachment portion configured to be attached to the predetermined members, a pair of leg portions protruding in the same direction away from the attachment portion, extending portions extending in a direction from tip end portions of the pair of leg portions toward base end portions of the leg portions, a coupling piece coupling the base end portions of the pair of leg portions, a first restricting portion that is located at an intermediate portion of the coupling piece and faces extending ends of the extending portions, and second restricting portions that protrude from two sides in a longitudinal direction of the coupling piece in a manner of sandwiching the first restricting portion, extend in a protruding direction of the leg portions, and face inner side surfaces of the leg portions.

The leg portions, the extending portions, and the second restricting portions are arranged such that, when the leg portions are bent by a force applied inward in a left-right direction, the extending ends of the extending portions come into contact with the first restricting portion, and the inner side surfaces of the leg portions come into surface contact with the second restricting portions. Protruding ends of the second restricting portions are positioned between the leg portions and the extending portions extending in the direction from the tip end portions of the leg portions toward the base end portions of the leg portions, and are positioned so as to be surrounded by the leg portions and the extending portions.

The first restricting portion is formed by a lateral bar extending in the left-right direction at the intermediate portion of the coupling piece, and is formed to be capable of coming into surface contact with the extending ends of the extending portions.

The lateral bar is positioned in a vicinity of an intermediate position of a length of the leg portions in a protruding direction thereof, and a space is formed between the lateral bar and the attachment portion provided at the base end portions of the leg portions.

A width of the extending ends of the extending portions in a front-back direction and a width of the protruding ends of the second restricting portions in the front-back direction are substantially equal to a width of the base end portions of the leg portions in the front-back direction.

The plug further includes restricting pieces extending in a direction in which the restricting pieces face each other at facing sides of the pair of extending portions. The restricting pieces are displaced in the front-back direction from each other, and are provided at positions where the restricting pieces do not interfere with each other when the leg portions swing in the left-right direction.

The present invention further provides a buckle including the plug and a socket configured to be coupled to the plug.

Advantageous Effects of Invention

The plug for a buckle and the buckle using the plug according to the present invention can prevent deformation or damage to the plug, and the plug can normally engage with the socket even when an unnecessary force is applied to the leg portions of the plug. In addition, since tip ends of the pair of leg portions are not coupled to each other, the pair of leg portions can be bent by a light operation to release engagement, and operability is good.

DESCRIPTION OF EMBODIMENTS

Figure 1:
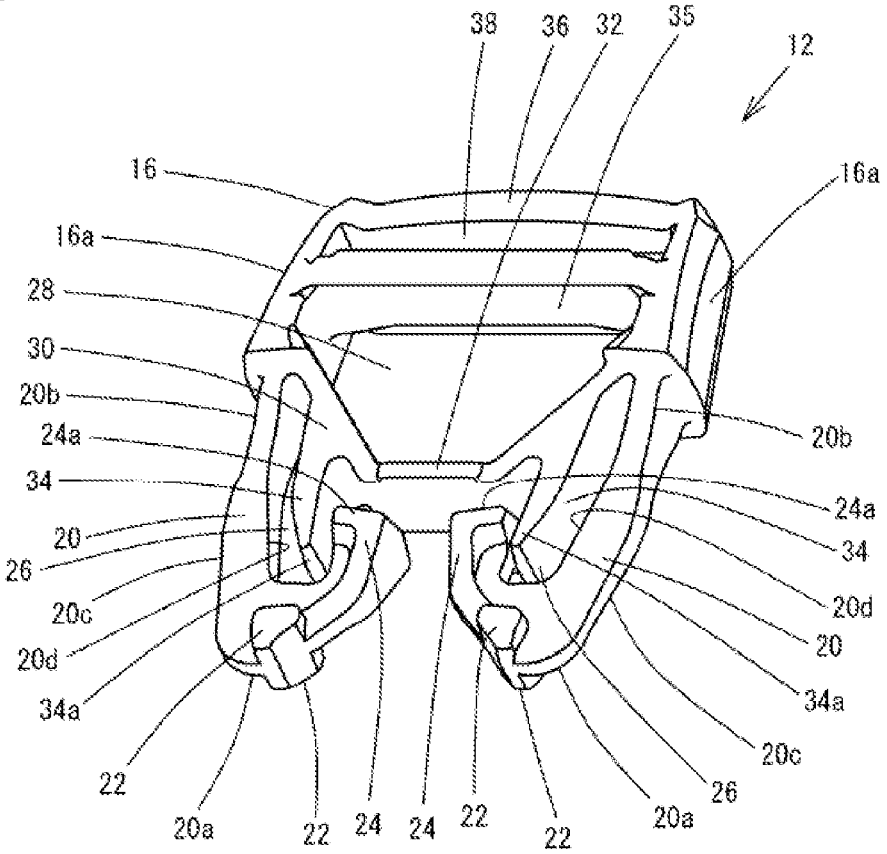
FIG. 1 is a perspective view showing a plug for a buckle according to a first embodiment of the present invention.
Figure 2A:
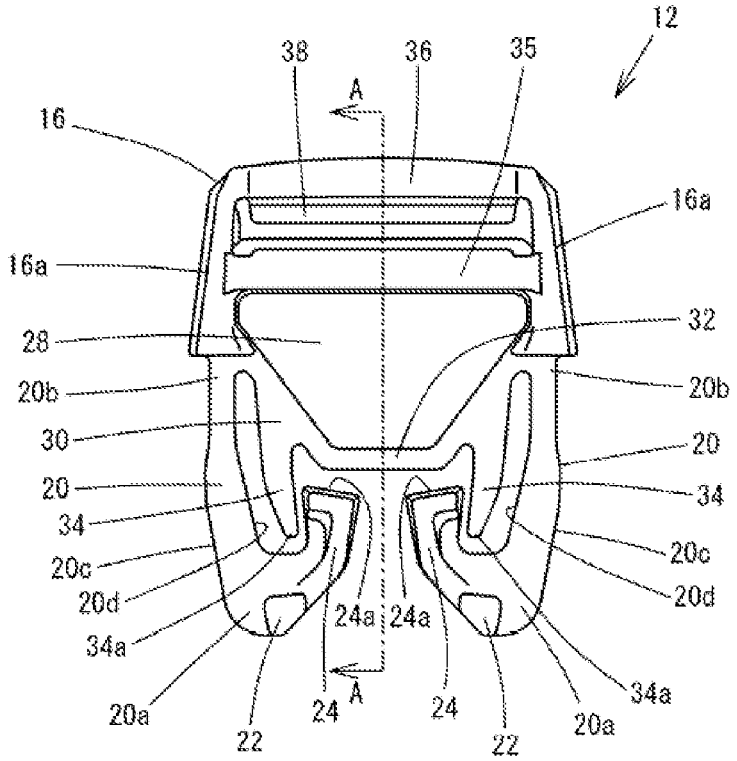
FIG. 2A is a front view and FIG. 2B is a right side view, showing the plug according to the first embodiment.
Figure 2B:
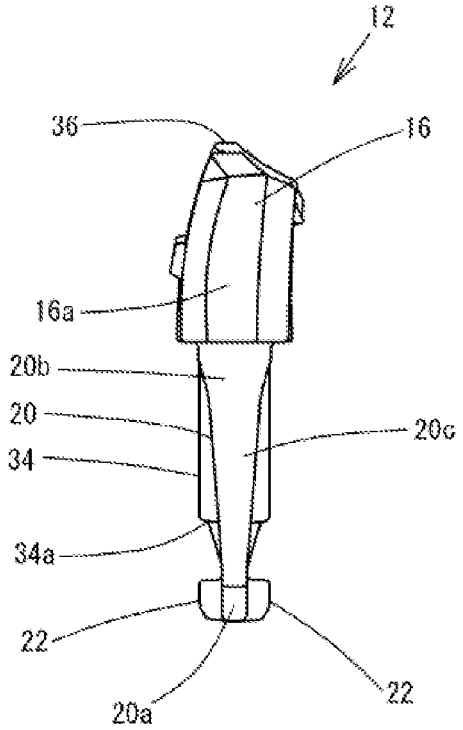
Figure 3A:
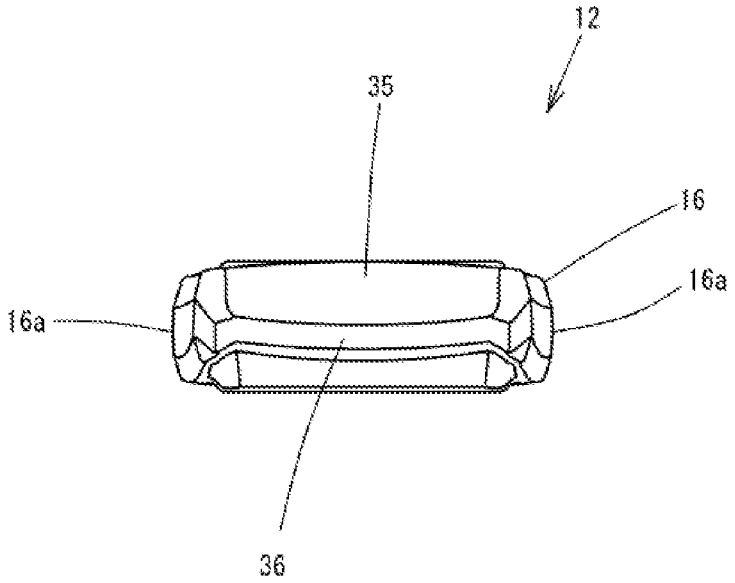
FIG. 3A is a plan view and FIG. 3B is a bottom view, showing the plug according to the first embodiment.
Figure 3B:
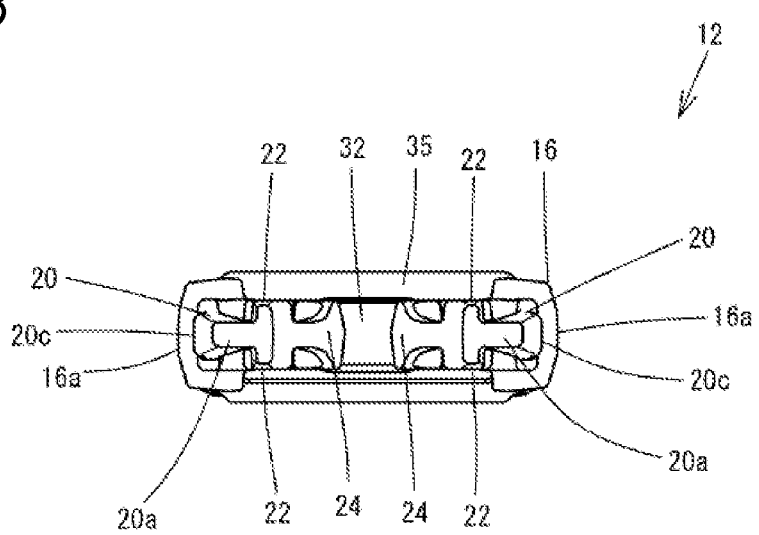
Figure 4:
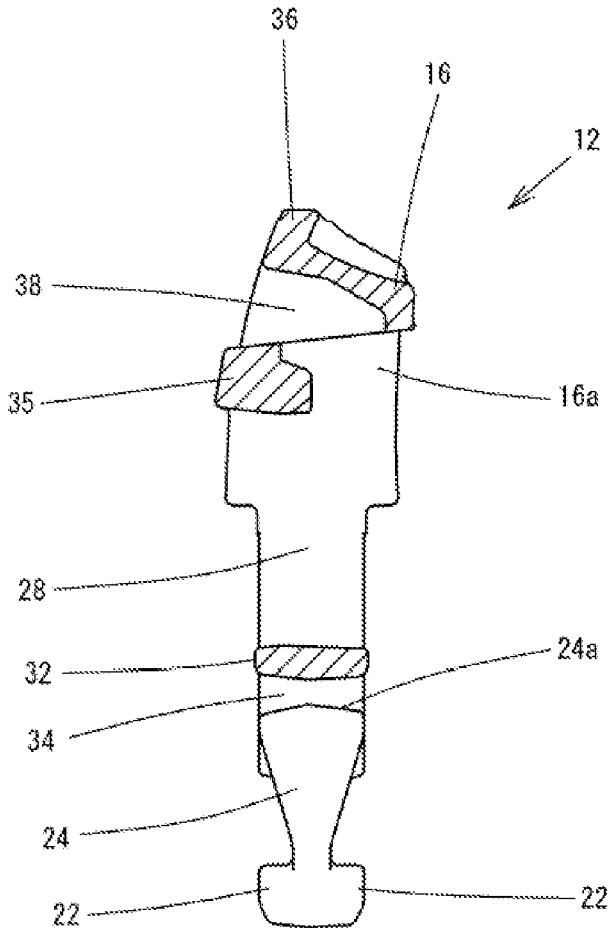
FIG. 4 is an enlarged cross-sectional view taken along a line A-A in FIG. 2A.
Figure 5:
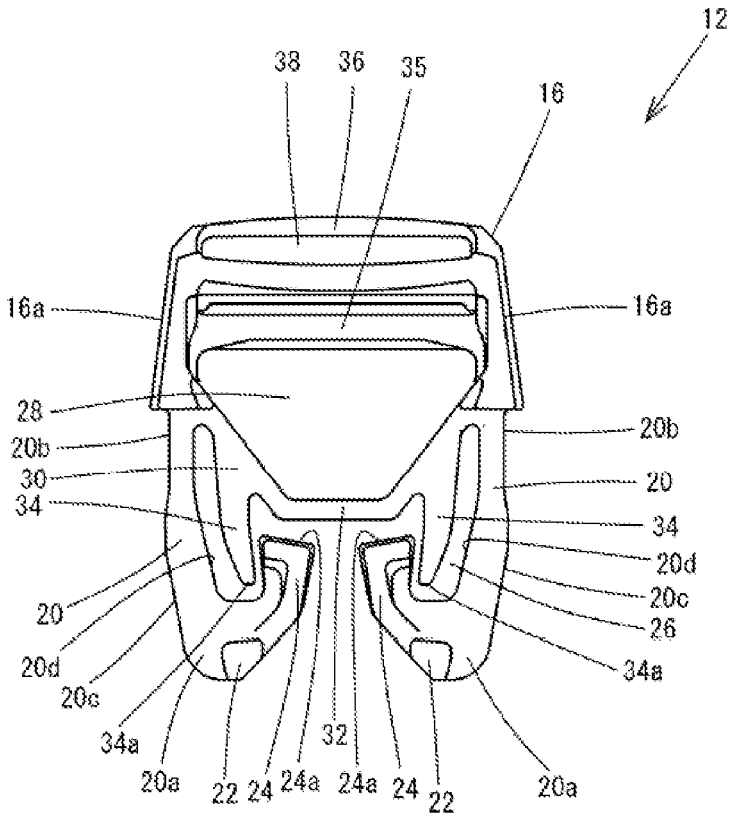
FIG. 5 is a rear view showing the plug according to the first embodiment.
Figure 6:
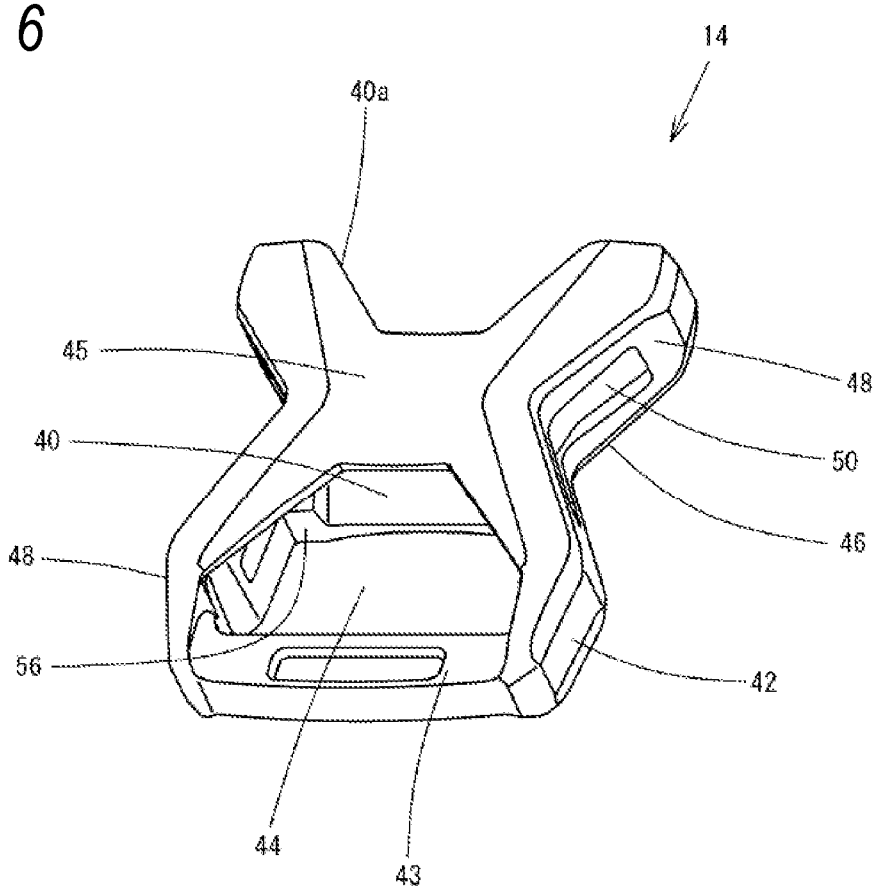
FIG. 6 is a perspective view showing a socket of the buckle according to the first embodiment.
Figure 7A:
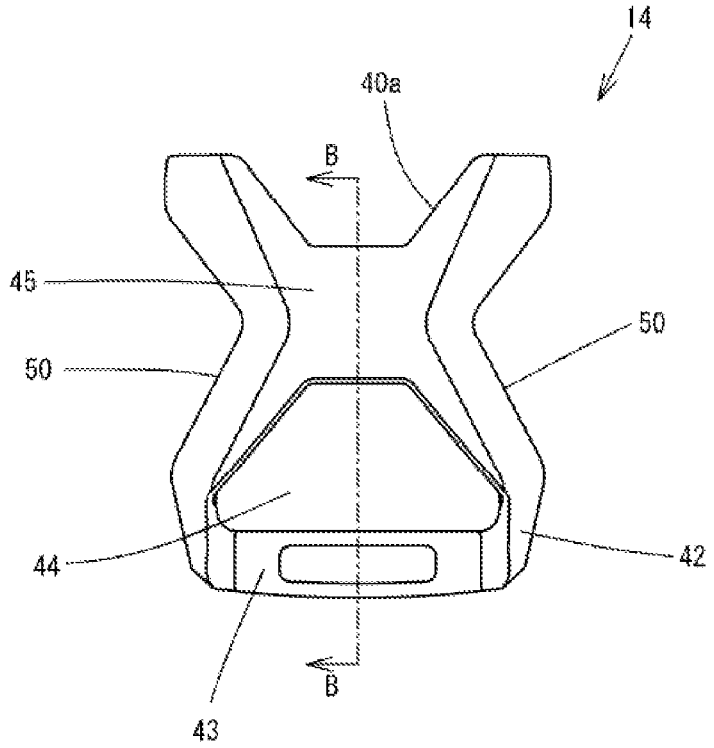
FIG. 7A is a front view and FIG. 7B is a right side view, showing the socket according to the first embodiment.
Figure 7B:
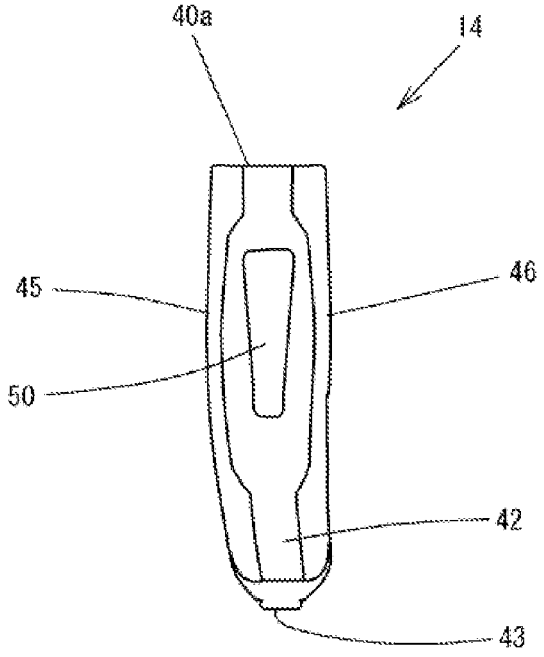
Figure 8A:
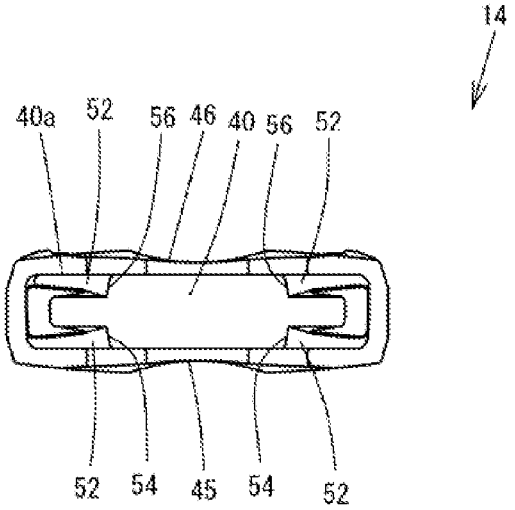
FIG. 8A is a plan view and FIG. 8B is a bottom view, showing the socket according to the first embodiment.
Figure 8B:
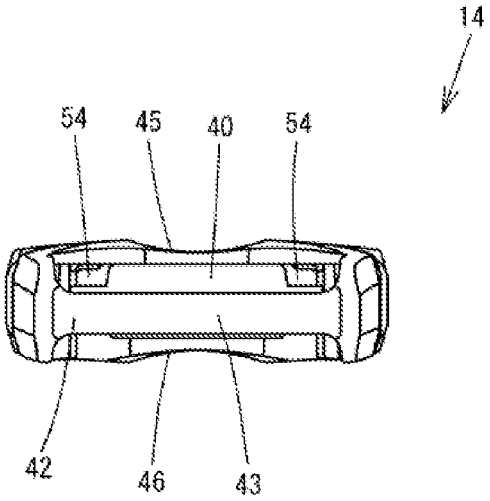

Hereinafter, a buckle 10 according to a first embodiment of the present invention will be described with reference to FIGS. 1 to 13. As shown in the drawings, the buckle 10 includes a plug 12 and a socket 14 to which the plug 12 is fitted and locked. Accordingly, the plug 12 and the socket 14 can be respectively attached to a tape, a belt, or another pair of members, and the plug 12 and the socket 14 can be coupled to each other or can be uncoupled from each other. In the following description, a direction in which the plug 12 is inserted into or separated from the socket 14 is referred to as a forward-rearward direction, a direction in which the plug 12 is inserted into the socket 14 is referred to as a forward direction, and a direction in which the plug 12 in a coupled state is separated from the socket 14 is referred to as a rearward direction. The frontward direction is also referred to as a protruding direction of a pair of leg portions 20 to be described later. The forward-rearward direction is also referred to as an upper-lower direction on a paper surface in FIGS. 2A and 2B. A direction in which the pair of leg portions 20 of the plug 12 face each other is referred to as a left-right direction, and the left-right direction is a left-right direction on the paper surface in FIG. 2A. A direction orthogonal to the left-right direction and the forward-rearward direction is referred to as a front-back direction or a thickness direction.

The plug 12 is formed of a synthetic resin such as polyacetal, polyamide, and polypropylene by integral molding. As shown in FIGS. 1 to 5 and FIGS. 11 to 13, the plug 12 includes an attachment portion 16 through which a tape, a belt, and other predetermined members are inserted and coupled, a pair of leg portions 20 that protrude in a direction away from the attachment portion 16 and are inserted into the socket 14, and engagement portions 22 that are engagement protrusions located at tip end portions 20*a* of the leg portions 20. The engagement portions 22 are respectively formed at front and back sides of each of the tip end portions 20*a* of the leg portions 20 in a manner of protruding in the front-back direction. The tip end portion 20*a* where the engagement portions 22 are provided is formed with an extending portion 24 extending to the rearward direction which is a direction toward a base end portion 20*b* side of each of the leg portions 20.

The pair of leg portions 20 are symmetrical to each other and protrude at the same length. At the base end portion 20*b* side of the leg portions 20, a thickness in the left-right direction is smaller than a thickness in the front-back direction, and it is easy to elastically deform the leg portions 20 in the left-right direction. The thickness in the front-back direction becomes smaller toward the tip end portion 20*a*. The leg portion 20 is formed into a shape in which a width in the left-right direction is substantially equal to a width in the vicinity of the base end portion 20 and gradually becomes larger toward the tip end portion 20*a* at a tip of the leg portion 20. The engagement portions 22 of the tip end portion 20*a* of the leg portion 20 are provided in a manner of protruding from the tip end portion 20*a* in a pair in the front-back direction. A width between front and back end surfaces of the engagement portions 22 at front and back sides of the leg portion 20 is substantially equal to a width of the leg portion 20 in the front-back direction of the base end portion 20*b*.

The extending portions 24 provided integrally with the pair of leg portions 20 extend toward the base end portion 20*b* side while being slightly separated inward so as to face each other at the tip end portions 20*a* of the leg portions 20, and the extending portions 24 extend parallel to a protruding direction of the leg portions 20. An extending end 24*a* of the extending portion 24 is located at an intermediate position of the leg portion 20 or located at a position slightly closer to the tip end portion 20*a* than the intermediate position. A space 26 that is long and narrow in the forward-rearward direction is formed between the extending portion 24 and the leg portion 20. The extending end 24*a* of the extending portion 24 is formed to a flat surface in the front-back direction and the left-right direction, and is formed to be capable of coming into surface contact with a lateral bar 32 that is a first restricting portion to be described later. A width of the extending end 24*a* of the extending portion 24 in the front-back direction is substantially equal to the width of the base end portion 20*b* of the leg portion 20 in the front-back direction.

A coupling piece 30 is integrally provided between the base end portions 20*b* of the pair of leg portions 20. The coupling piece 30 and the attachment portion 16 form a trapezoidal space 28. The coupling piece 30 forms an upper side and right and left oblique sides of the trapezoid of the space 28. The lateral bar 32 that is a first restricting portion extending in the left-right direction at an intermediate portion of the coupling piece 30 is provided at an upper side portion of the space 28 formed by the coupling piece 30. Portions of the coupling piece 30 located at both left and right end portions of the lateral bar 32 form two oblique sides of the trapezoid of the space 28.

A pair of protruding pieces 34 are provided at the oblique sides of the trapezoid formed by the coupling piece 30. The protruding pieces 34 are second restricting portions protruding in parallel to a protruding direction of the leg portions 20. The lateral bar 32 that is the first restricting portion is located closer to the base end portion 20*b* than an intermediate position in a protruding length of the leg portion 20 and is provided in the left-right direction. The lateral bar 32 is close to the extending end 24*a* of the extending portion 24. The protruding piece 34 that is the second restricting portion is located close to the leg portion 20 and the extending portion 24 in the space 26 between the leg portion 20 and the extending portion 24, and the protruding piece 34 faces the leg portion 20 and the extending portion 24 in the left-right direction. A width of a protruding end 34*a* of the protruding piece 34 in the front-back direction is substantially equal to the width of the base end portion 20*b* of the leg portion 20 in the front-back direction. Therefore, the protruding end 34*a* of the second restricting portion 34 is located in the space 26 between the leg portion 20 and the extending portion 24 extending in a direction from the tip end portion 20*a* of the leg portion 20 toward the base end portion 20*b* of the leg portion 20, and is provided in a manner of being surrounded by the leg portion 20 and the extending portion 24.

The attachment portion 16 provided integrally with the leg portion 20 includes a pair of side edge portions 16*a* that are integrally continuous with respective base end portions 20*b* of the pair of leg portions 20, a first bar 35 coupling intermediate portions of the side edge portions 16*a*, and a second bar 36 coupling end portions of the side edge portions 16*a* at an opposite side to the leg portion 20. The first bar 35 and the second bar 36 are provided in parallel in the left-right direction. The first bar 35 and the second bar 36 are integrally formed with an insertion hole 38 for an attachment member such as a tape between the first bar 35 and the second bar 36. The space 28 formed by the attachment portion 16 and the coupling piece 30 also functions as an insertion hole for a tape or the like, together with the insertion hole 38.

The socket 14 is also formed of a synthetic resin such as polyacetal, polyamide, and polypropylene by integral molding. As shown in FIGS. 6 to 13, the socket 14 includes a hollow plug fitting portion 40 into which the leg portions 20 of the plug 12 are inserted, and an attachment portion 42 located at an opposite side of a plug insertion port 40*a* of the plug fitting portion 40. The attachment portion 42 is formed with an insertion hole 44 through which a tape, a belt, or other predetermined members are inserted.

The plug fitting portion 40 of the socket 14 is a flat housing in which a front surface portion 45 and a back surface portion 46 face each other at a predetermined interval and an insertion space for the plug 12 is formed. The front surface portion 45 and the back surface portion 46 are formed into a substantially V shape in which end portions of the front surface portions 45 and the back surface portion 46 at the plug insertion port 40*a* side are inclined to the center of the plug insertion port 40*a* in the forward-rearward direction towards central portions of the front surface portion 45 and the back surface portion 46. Side wall portions 48 facing each other are provided on side surfaces of the socket 14 in the left-right direction, and an operation port 50 is formed in a central portion in the forward-rearward direction of each of the side wall portions 48. The operation port 50 exposes an operation portion 20*c* on an outer side surface of the leg portion 20. The operation ports 50 are formed to be bent into a V shape in a manner of coming close to each other in the left-right direction, and are formed in a manner in which the operation portions 20*c* can be exposed to two sides in the left-right direction of the operation portion 50.

Guide portions 52 that guide an insertion operation of the plug 12 are formed continuously from the plug insertion port 40*a* on inner surfaces of the front surface portion 45 and the back surface portion 46 of the plug fitting portion 40. The guide portion 52 is provided in the forward-rearward direction from the plug insertion port 40*a*, and guides a sliding operation of the plug 12 in the forward-rearward direction. Counterpart engagement portions 54 that engage with the engagement portions 22 at a front surface side of the leg portions 20 are formed at positions of the front surface portion 45 of the plug fitting portion 40 close to the attachment portion 42, and the counterpart engagement portions 54 protrude into a space in the plug fitting portion 40. Further, counterpart engagement portions 56 are formed at left and right sides of the back surface portion 46 of the socket 14. The counterpart engagement portions 56 are step portions formed inside the side wall portions 48 close to an opening where the insertion hole 44 of the attachment portion 42 is formed. The counterpart engagement portions 56 engage with the engagement portions 22 at a back surface side of the leg portions 20 of the plug 12.

Next, a usage method and an engagement operation of the buckle 10 according to the present embodiment will be described. First, in order to attach a tape member or the like to the plug 12 of the buckle 10, an end portion of the tape member (not shown) for coupling is inserted from a back surface side of the space 28 of the attachment portion 16 of the plug 12, and is inserted into the insertion hole 38 crossing over an outer periphery of the first bar 35. Then, the end portion of the tape member is overlapped with the tape member at a back surface side of the insertion hole 38, and is drawn out so that a length of the tape member can be freely adjusted. On the other hand, a tape member or the like (not shown) attached to the socket 14 is coupled to a coupling bar 43 of the attachment portion 42 through the insertion hole 44, and the tape member cannot be adjusted.

Figure 9:
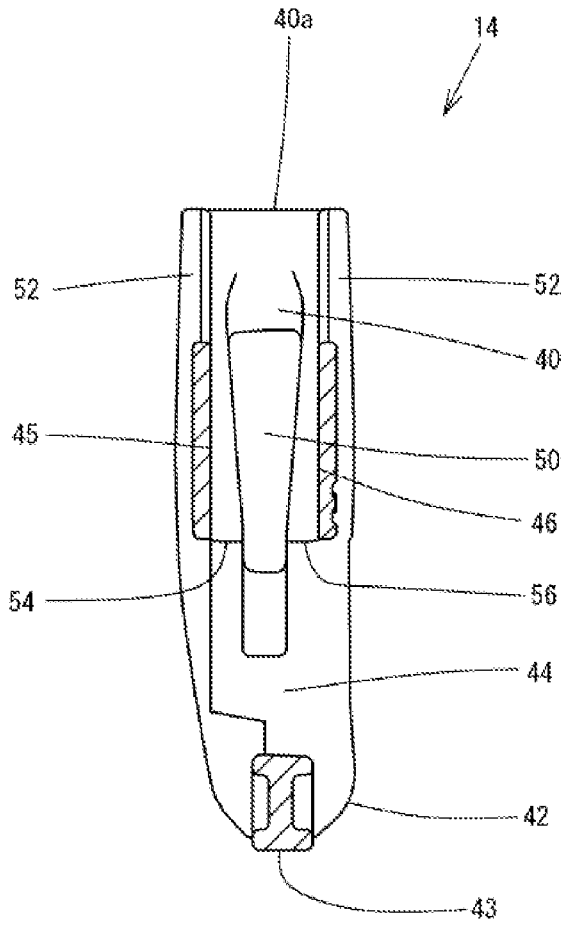
FIG. 9 is an enlarged cross-sectional view taken along a line B-B in FIG. 7A.
Figure 10:
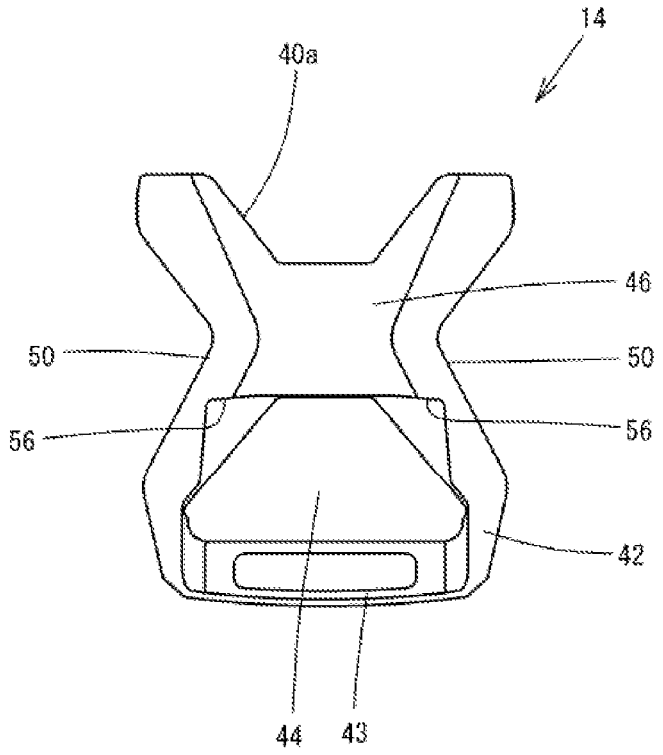
FIG. 10 is a rear view showing the socket according to the first embodiment.
Figure 11:
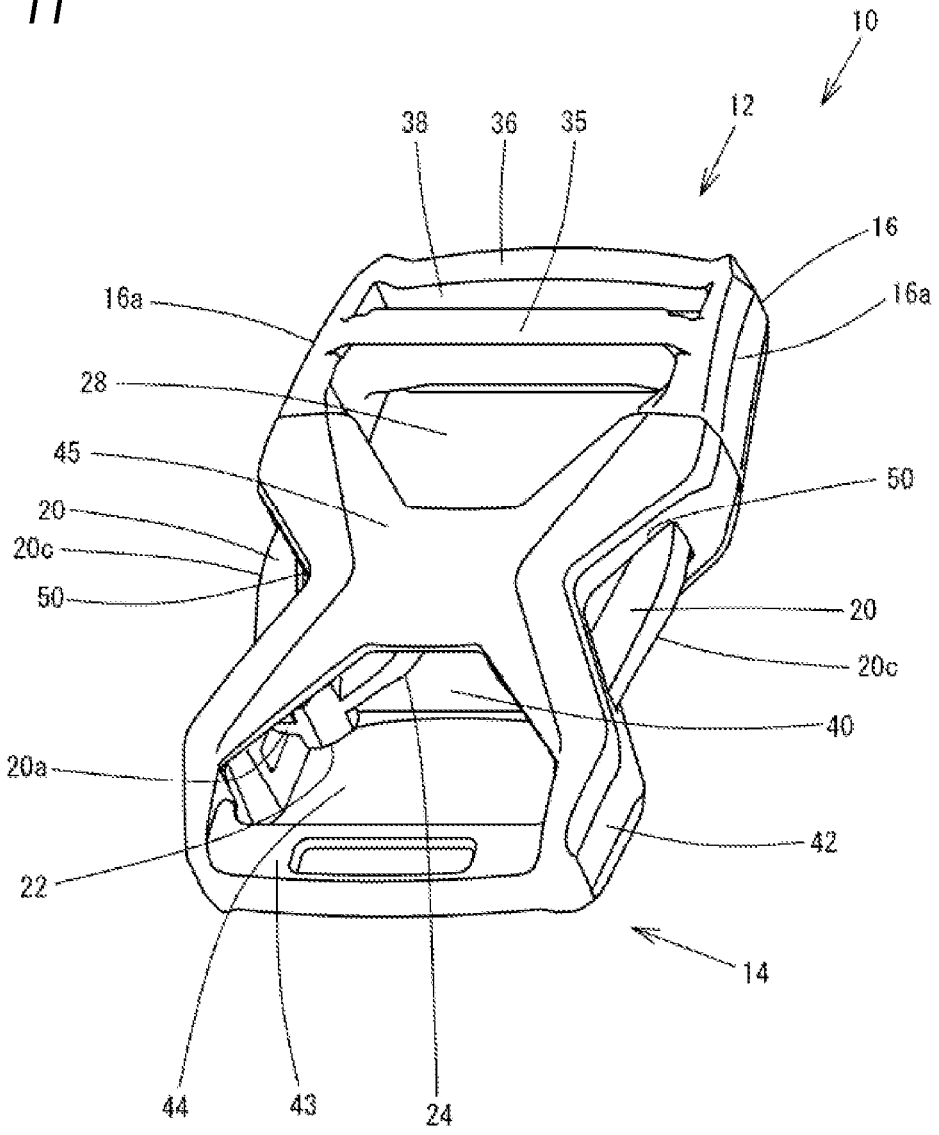
FIG. 11 is a perspective view showing a coupled state of the plug and the socket of the buckle according to the first embodiment.
Figure 12:
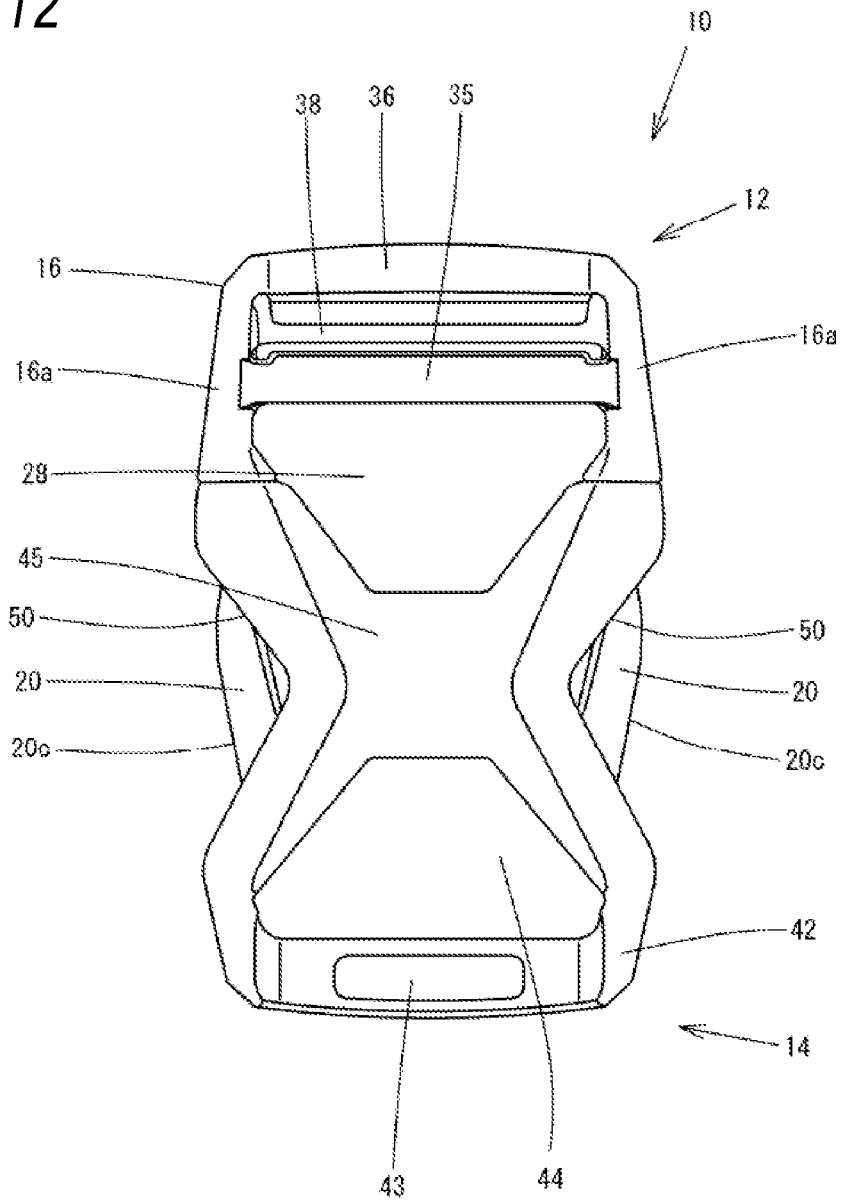
FIG. 12 is a front view showing a coupled state of the plug and the socket of the buckle according to the first embodiment.
Figure 13:
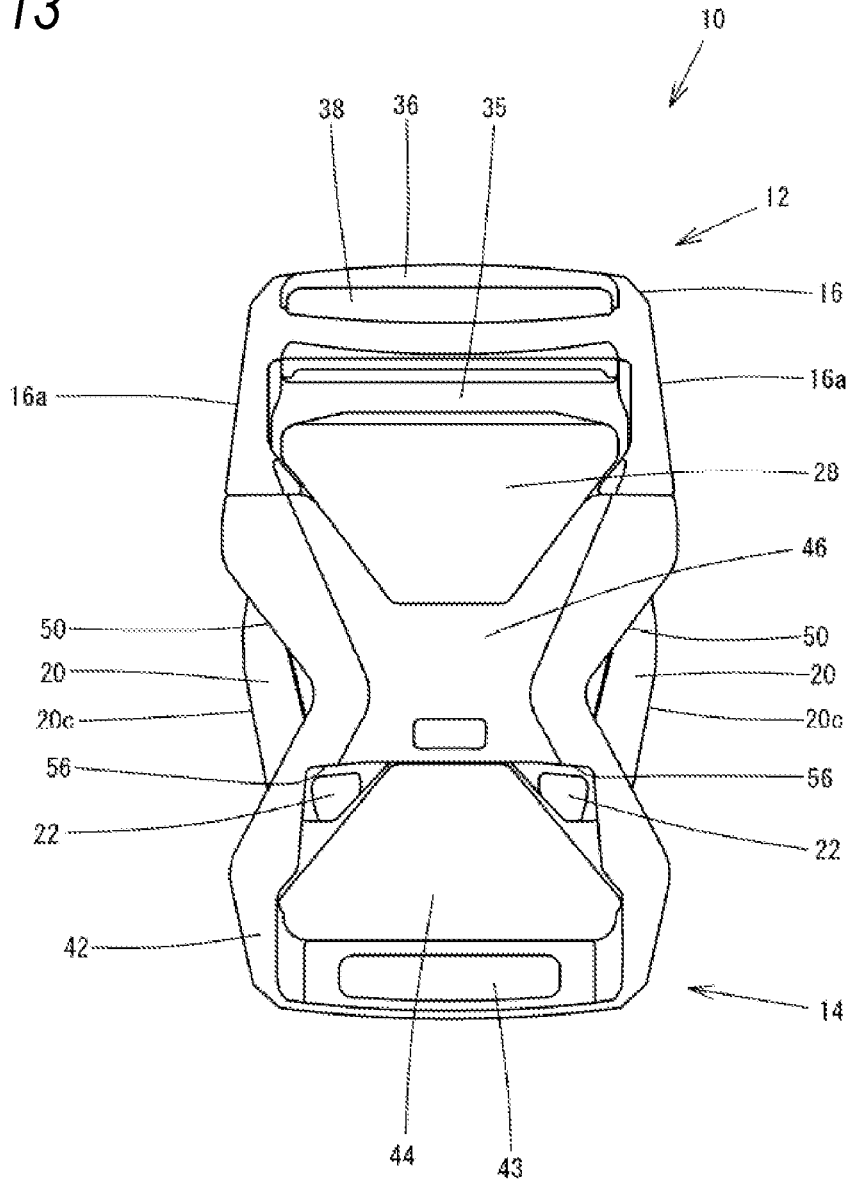
FIG. 13 is a rear view showing a coupled state of the plug and the socket of the buckle according to the first embodiment.
Figure 14:
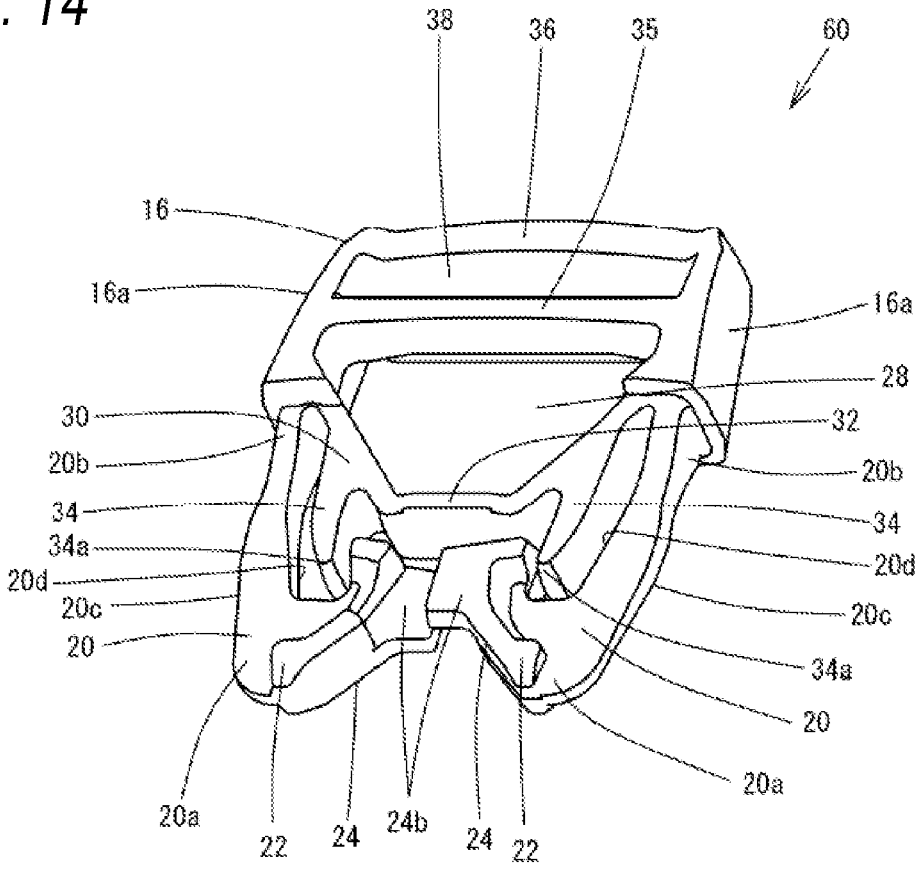
FIG. 14 is a perspective view showing a plug for a buckle according to a second embodiment of the present invention.
Figure 15:
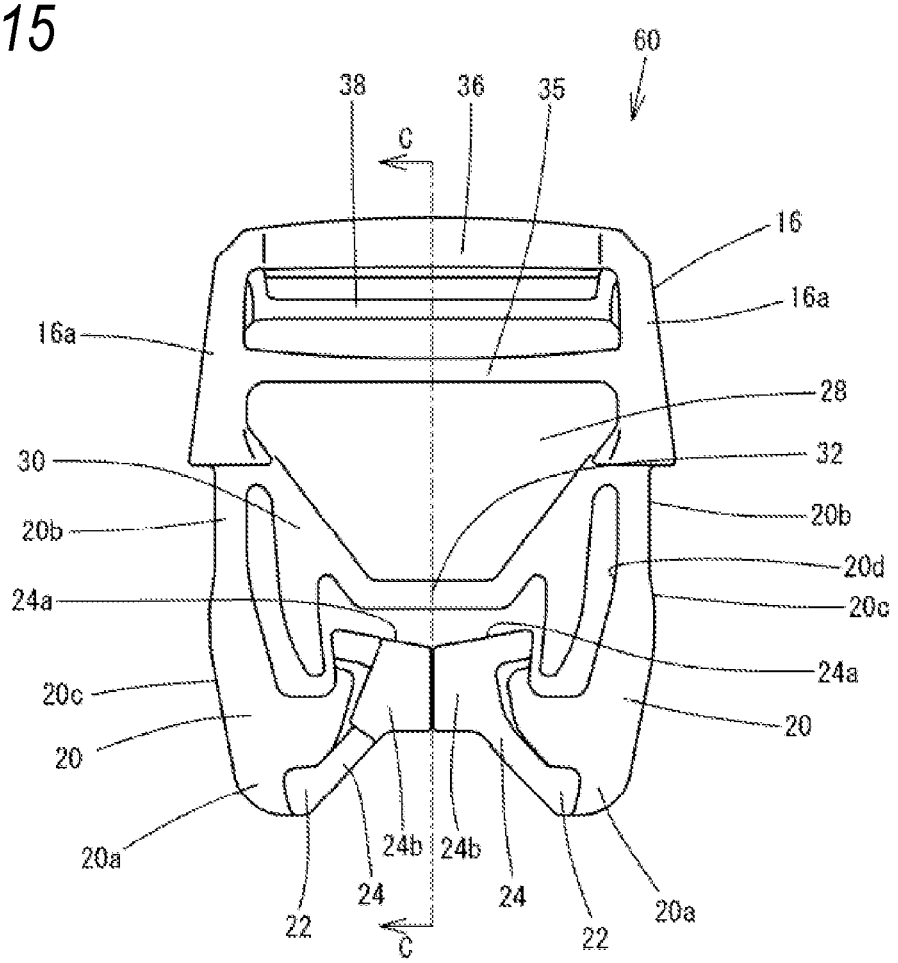
FIG. 15 is a front view showing the plug according to the second embodiment.
Figure 16A:
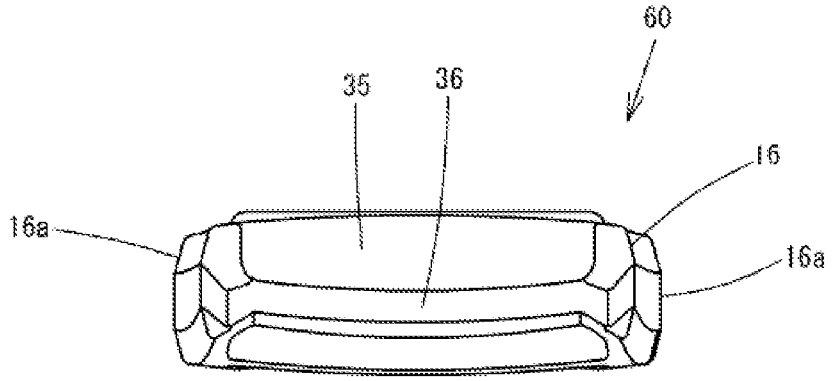
FIG. 16A is a plan view and FIG. 16B is a bottom view, showing the plug according to the second embodiment.
Figure 16B:
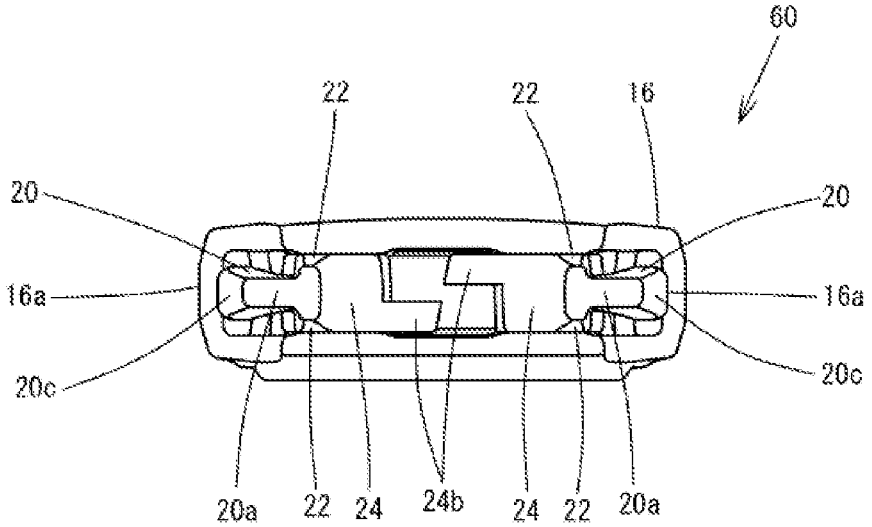
Figure 17:
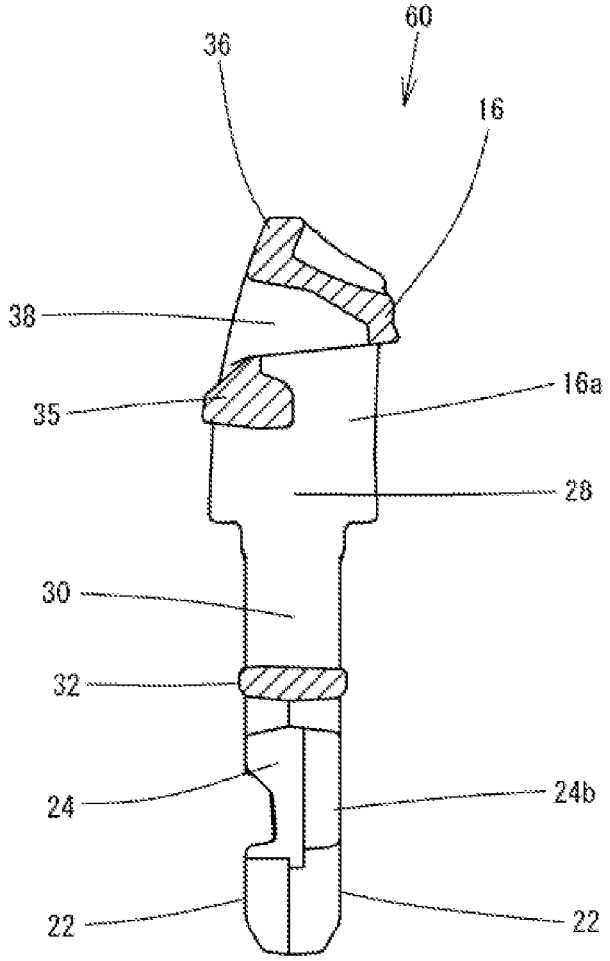
FIG. 17 is an enlarged cross-sectional view taken along a line C-C in FIG. 15.
Figure 18:
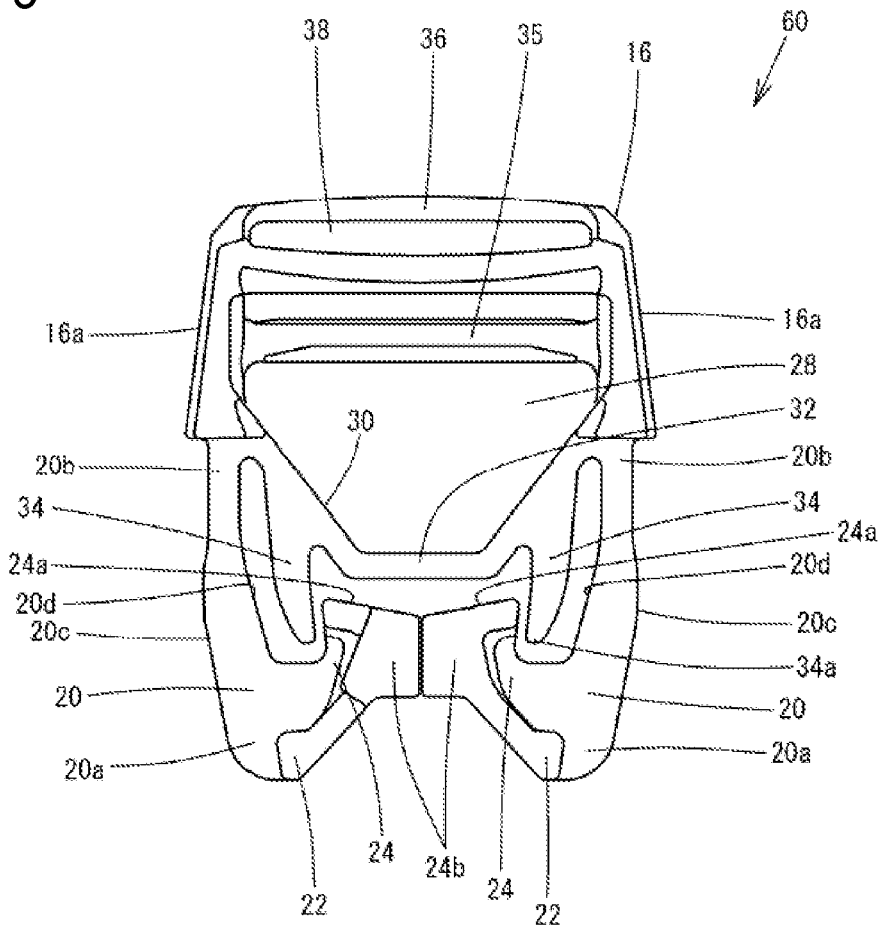
FIG. 18 is a rear view showing the plug according to the second embodiment.

As shown in FIGS. 9 to 11, the leg portions 20 of the plug 12 face the plug insertion port 40*a* of the plug fitting portion 40 of the socket 14, and then the plug 12 is pushed into the socket 14, Accordingly, the plug 12 and the socket 14 are coupled to each other. When the leg portions 20 are inserted into the plug fitting portion 40, outer side surfaces of the engagement portions 22 of the leg portions 20 come into contact with the counterpart engagement portions 54, and the leg portions 20 are inserted while being elastically deformed in a direction in which the leg portions 20 temporarily come close to each other. When the plug 12 is further pushed into the socket 14, the pair of leg portions 20 that was elastically deformed due to separation of the engagement portions 22 from the counterpart engagement portions 54 return to original positions, and the engagement portions 22 on the front and back sides of the pair of leg portions 20 respectively face the counterpart engagement portions 54 and 56 and are engaged with the counterpart engagement portions 54 and 56. Since the engagement portions 22 protrude from the leg portions 20 in the front-back direction and are engaged with the counterpart engagement portions 54 and 56 at the front surface portion 45 and the back surface portion 46 of the socket 14, when a tensile force is applied in the longitudinal direction of the leg portions 20, no force is generated in the left-right direction of the leg portions 20, engagement is stable and an engagement force is strong.

In order to uncouple the plug 12 and the socket 14, the operation portions 20*c* of the pair of leg portions 20 are pressed from the outside, and the engagement portions 22 of the plug 12 are elastically deformed to positions not facing the counterpart engagement portions 54 and 56 of the socket 14. In this state, when the plug 12 and the socket 14 are slightly moved relative to each other in a direction away from each other, the engagement portions 22 are separated so as to be pushed out from engagement positions along side surface portions of the counterpart engagement portions 54 due to an elastic force of the leg portions 20. As a result, the plug 12 and the socket 14 are easily disengaged.

Next, a case in which an unnecessary force acts on the plug 12 of the buckle 10 from the outside will be described. When a force acts on the leg portions 20 of the plug 12 to an inner side in the left-right direction, the extending ends 24*a* of the extending portions 24 of the leg portions 20 come into contact with the lateral bar 32 that is the first restricting portion, deformation beyond the lateral bar 32 is restricted. At this time, inner side surfaces 20*d* of the leg portions 20 come into surface contact with the protruding pieces 34 that are the second restricting portion, and similarly, deformation beyond the protruding pieces 34 is prevented. When a force acts on the leg portions 20 to an outer side in the left-right direction, the extending portions 24 come into surface contact with the protruding pieces 34 that are the second restricting portion, and similarly, deformation beyond the protruding pieces 34 is prevented.

When a force in a twisting direction acts on the leg portions 20, tip end portions 20*a* of the leg portions 20 tend to come onto tip end portions of the protruding pieces 34. However, since the width of the extending end 24*a* of the extending portion 24 in the front-back direction and the width of the protruding end 34*a* of the protruding piece 34 in the front-back direction are substantially equal to the width of the base end portion 20*b* of the leg portion 20 in the front-back direction, the extending portions 24 do not come onto the protruding portions 34.

According to the plug 12 of the buckle 10 in the present embodiment, deformation of the plug 12 in inward and outward directions is prevented even when an unnecessary force is applied to the leg portions 20 of the plug 12, and positions of the leg portions 20 are restricted even when a force in a twisting direction is applied to the leg portions 20. Accordingly, a reliable engagement between the plug 12 and the socket 14 can be easily achieved. In particular, when a force acts on the leg portion 20 toward an inner side in the left-right direction, positions of the leg portions 20 are restricted by the lateral bar 32 that is the first restricting portion and the protruding pieces 34 that are the second restricting portion, and deformation or damage to the leg portions 20 is prevented. Further, since the extending portion 24 extends from the tip end portion 20*a* of the leg portion 20 toward the base end portion 20*b* and is positioned in a manner of surrounding the second restricting portion 34, the second restricting portion 34 is prevented from being caught by other members, and the second restricting portion 34 is effectively protected.

In addition, the coupling piece 30 that couples the base end portions 20*b* of the leg portions 20 forms a trapezoidal shape, and forms the space 28 that becomes wide at the tip end portion 20*a* side of the leg portions 20. Accordingly, a tape member or the like can be easily attached to the attachment portion 16, a length of the protruding piece 34 can be reduced, and the short protruding piece 34 can reliably obtain a function of restricting the leg portions 20. Further, since the tip ends of the leg portions 20 are not coupled to each other, the pair of leg portions 20 can be bent by a light pressing operation of the operation portions 20*c* to release engagement, and operability is good.

Next, a second embodiment of the present invention will be described with reference to FIGS. 14 to 18. The same components as those in the embodiment described above are denoted by the same reference numerals, and a description thereof will be omitted. A plug 60 for a buckle according to this embodiment has the same configuration as the plug according to the embodiment described above. The plug 60 integrally includes restricting pieces 24*b* facing each other and having a step in the thickness direction. The restricting pieces 24*b* are provided at the extending portions 24 that are integrally provided at the pair of leg portions 20. The restricting pieces 24*b* extend in the left-right direction from facing side surfaces of the extending portions 24 that are formed to extend from the pair of leg portions 20 and the restricting pieces 24*b* extend in a direction in which the restricting pieces 24*b* come close to each other. The restricting pieces 24*b* are formed into a quadrangular plate shape. The restricting pieces 24*b* are displaced from each other in a front-back direction of the plug 60, and are provided at positions where the restricting pieces 24*b* do not interfere with each other even when the leg portions 20 swing in a direction of coming close to each other.

The plug 60 according to this embodiment is used in the same manner as the plug according to the embodiment described above, and has the same function and effect as those in the embodiment described above. Even when a force in a twisting direction is applied to the leg portions 20, similarly, the extending ends 24*a* of the extending portions 24 do not come onto tip end portions of the protruding pieces 34, and the restricting pieces 24*b* come into contact with each other due to the twisting, so that deformation or damage to the leg portions 20 is prevented. In addition, when the plug 60 is to be inserted into a socket, even if the plug 60 is inserted in an erroneous direction, the restriction pieces 24*b* come into contact with a plug insertion port of the socket and the insertion is stopped. Therefore, damage to the leg portions 20 due to erroneous insertion can be prevented.

The buckle according to the present invention is not limited to the embodiments described above, and a shape of the coupling piece 30 of the plug 12 may be a semicircular shape or a polygonal shape in addition to a trapezoidal shape. The engagement portion 22 may be a portion that protrudes in the left-right direction in addition to a portion that protrudes in the front-back direction, and may be engaged with a counterpart engagement portion of the socket 14. A position of the lateral bar 32 that is the first restricting portion is preferably provided in the vicinity of an intermediate portion of the coupling piece 30 in the protruding direction of the leg portions 20, and may be provided at a position in a range of 40% to 60% of the length of the leg portions 20. It is preferable that a width of the extending end 24*a* of the extending portion 24 in the front-back direction and a width of the protruding end 34*a* of the protruding piece 34 in the front-back direction are substantially equal to a width of the base end portion 20*b* of the leg portion 20 in the front-back direction. Alternatively, either the width of the extending end 24*a* of the extending portion 24 in the front-back direction or the width of the protruding end 34*a* of the protruding piece 34 in the front-back direction may be 80% or more of the width of the base end 20*b* in the front-back direction.

REFERENCE SIGNS LIST

10 buckle
12, 60 plug
14 socket
16, 42 attachment portion
20 leg portion
20*a* tip end portion
20*b* base end portion
20*c* operation portion
20*d* inner side surface
22 engagement portion
24 extending portion
24*a* extending end
24*b* restricting piece
26, 28 space
30 coupling piece
32 lateral bar (first restricting portion)
34 protruding piece (second restricting portion)
34*a* protruding end
38, 44 insertion hole
40 plug fitting portion
40*a* plug insertion port
45 front surface portion
46 back surface portion
48 side wall portion
50 operation port
52 guide portion
54, 56 counterpart engagement portion

The invention claimed is:

1. A plug for a buckle, the buckle including the plug and a socket that are configured to be coupled to each other or uncoupled from each other and to be respectively attached to predetermined members, the plug comprising:

an attachment portion configured to be attached to one of the predetermined members;

a pair of leg portions protruding in the same direction away from the attachment portion;

extending portions extending in a direction from tip end portions of the pair of leg portions toward base end portions of the leg portions;

a coupling piece coupling the base end portions of the pair of leg portions;

a first restricting portion that is located at an intermediate portion of the coupling piece and faces extending ends of the extending portions; and second restricting portions that protrude from two sides in a longitudinal direction of the coupling piece in a manner of sandwiching the first restricting portion, extend in a protruding direction of the leg portions, and face inner side surfaces of the leg portions, wherein the extending ends of the extending portions are configured to be come into contact with the first restricting portion.

2. The plug according to claim 1, wherein the leg portions, the extending portions, and the second restricting portions are arranged such that, when the leg portions are bent by a force applied inward in a left-right direction, the extending ends of the extending portions come into contact with the first restricting portion and the inner side surfaces of the leg portions come into surface contact with the second restricting portions.

3. The plug according to claim 2, wherein the first restricting portion is formed by a lateral bar extending in the left-right direction at the intermediate portion of the coupling piece and is configured to come into surface contact with the extending ends of the extending portions.

4. The plug according to claim 3, wherein the lateral bar is positioned in a vicinity of an intermediate position of a length of the leg portions in a protruding direction thereof, and a space is formed between the lateral bar and the attachment portion provided at the base end portions of the leg portions.

5. A buckle comprising:

the plug according to claim 3; and a socket configured to be coupled to the plug.

6. The plug according to claim 2, wherein protruding ends of the second restricting portions are positioned between the leg portions and the extending portions extending in the direction from the tip end portions of the leg portions toward the base end portions of the leg portions, and wherein protruding ends of the second restricting portions are positioned so as to be surrounded by the leg portions and the extending portions.

7. The plug according to claim 2, wherein a width of the extending ends of the extending portions in a front-back direction and a width of protruding ends of the second restricting portions in the front-back direction are substantially equal to a width of the base end portions of the leg portions in the front-back direction.

8. The plug according to claim 2, further comprising:

restricting pieces extending in a direction in which the restricting pieces face each other at facing sides of the pair of extending portions, wherein the restricting pieces are displaced in the front-back direction from each other and are provided at positions where the restricting pieces do not interfere with each other when the leg portions swing in the left-right direction.

9. A buckle comprising:

the plug according to claim 2; and a socket configured to be coupled to the plug.

10. The plug according to claim 1, wherein the first restricting portion is formed by a lateral bar extending in the left-right direction at the intermediate portion of the coupling piece and is configured to come into surface contact with the extending ends of the extending portions.

11. The plug according to claim 10, wherein the lateral bar is positioned in a vicinity of an intermediate position of a length of the leg portions in a protruding direction thereof, and a space is formed between the lateral bar and the attachment portion provided at the base end portions of the leg portions.

12. A buckle comprising:

the plug according to claim 11; and a socket configured to be coupled to the plug.

13. A buckle comprising:

the plug according to claim 10; and a socket configured to be coupled to the plug.

14. The plug according to claim 1, wherein protruding ends of the second restricting portions are positioned between the leg portions and the extending portions extending in the direction from the tip end portions of the leg portions toward the base end portions of the leg portions, and wherein protruding ends of the second restricting portions are positioned so as to be surrounded by the leg portions and the extending portions.

15. A buckle comprising:

the plug according to claim 14; and a socket configured to be coupled to the plug.

16. The plug according to claim 1, wherein a width of the extending ends of the extending portions in a front-back direction and a width of protruding ends of the second restricting portions in the front-back direction are substantially equal to a width of the base end portions of the leg portions in the front-back direction.

17. A buckle comprising:

the plug according to claim 16; and a socket configured to be coupled to the plug.

18. The plug according to claim 1, further comprising:

restricting pieces extending in a direction in which the restricting pieces face each other at facing sides of the pair of extending portions, wherein the restricting pieces are displaced in the front-back direction from each other and are provided at positions where the restricting pieces do not interfere with each other when the leg portions swing in the left-right direction.

19. A buckle comprising:

the plug according to claim 18; and a socket configured to be coupled to the plug.

20. A buckle comprising:

the plug according to claim 1; and a socket configured to be coupled to the plug.

* * * * *